US006851488B2

(12) United States Patent
Batarseh

(10) Patent No.: US 6,851,488 B2
(45) Date of Patent: Feb. 8, 2005

(54) LASER LINER CREATION APPARATUS AND METHOD

(75) Inventor: Samih Batarseh, Mount Prospect, IL (US)

(73) Assignee: Gas Technology Institute, Des Plaines, IL (US)

( * ) Notice: Subject to any disclaimer, the term of this patent is extended or adjusted under 35 U.S.C. 154(b) by 124 days.

(21) Appl. No.: 10/407,408

(22) Filed: Apr. 4, 2003

(65) Prior Publication Data

US 2004/0195003 A1 Oct. 7, 2004

(51) Int. Cl.[7] ..... E21B 11/02
(52) U.S. Cl. ..... 175/19; 175/11
(58) Field of Search ..... 175/19, 11, 13, 175/20, 22, 23

(56) References Cited

U.S. PATENT DOCUMENTS 2,628,424 A * 2/1953 McMillan et al. ..... 30/276
3,871,485 A 3/1975 Keenan, Jr.
4,066,138 A 1/1978 Salisbury et al.
4,090,572 A 5/1978 Welch
4,113,036 A 9/1978 Stout
4,282,940 A 8/1981 Salisbury et al.
4,973,205 A * 11/1990 Spaulding ..... 408/16
5,031,158 A * 7/1991 Chamuel ..... 367/118
5,107,936 A 4/1992 Foppe
6,454,030 B1 * 9/2002 Findley et al. ..... 175/425

* cited by examiner

*Primary Examiner*—Frank Tsay
(74) *Attorney, Agent, or Firm*—Mark E. Fejer

(57) ABSTRACT

A method and apparatus for forming an in situ borehole liner in which a laser beam from a laser energy assembly disposed within a transparent drill head enclosure of a drill head assembly is directed into a rock formation to be drilled and a portion of the rock formation is melted, forming molten rock. The drill head assembly is directed into the molten rock forming a borehole having a borehole wall. At least one air stream from the drill head assembly is directed into the molten rock forming the molten rock against the borehole wall after which the molten rock against the borehole wall is cooled, forming a borehole liner.

18 Claims, 4 Drawing Sheets

LASER LINER CREATION APPARATUS AND METHOD

BACKGROUND OF THE INVENTION

1. Field of the Invention

This invention is related to a method and apparatus for drilling wells using a drill head assembly employing laser energy assemblies as cutters. More particularly, this invention relates to a method and apparatus for drilling wells which produces a well or borehole liner in situ as the drilling operation progresses, thereby enabling the elimination of drill casing liners employed in conventional drilling operations.

2. Description of Related Art

Traditional well drilling requires the use of drill casing liners when retrieving fluids such as oil to prevent the mixture of grains and particles with the fluid. These liners present an additional financial cost to the well completion operation, in addition to the time required to put them in place. Another problem associated with traditional drilling occurs when water is encountered in the formations being drilled. Keeping this water out of the well and preventing it from mixing with the oil can be a significant problem.

The use of lasers for the purpose of producing boreholes to enable the extraction of liquid and gaseous fuels from underground formations is well-known in the art. U.S. Pat. No. 4,066,138 to Salisbury et al. teaches an earth boring apparatus mounted above ground that directs an annulus of high powered laser energy downwardly for boring a cylindrical hole by fusing successive annular regions of the stratum to be penetrated at a power level that shatters and self-ejects successive cores from the hole.

U.S. Pat. No. 4,282,940 to Salisbury et al. teaches an apparatus for perforating oil and gas wells. Using this method, a high-powered coherent light beam is axially directed along the borehole to a predetermined depth and deflected along a beam axis. The beam is focused to concentrate at each of a plurality of spaced focal points along the deflected beam. This, in turn, is said to provide a significant increase in the distance that calculated oil or gas bearing formations can be perforated, thereby increasing the yield by more conventional means.

The use of lasers for drilling is also taught by U.S. Pat. No. 4,113,036 to Stout in which underground boreholes are drilled through a formation from a plurality of vertical boreholes by use of laser beams to form a subsurface, three-dimensional bore passage pattern for in situ preparation of fossil fuel deposits to be recovered and a laser beam is projected vertically through an angularly adjusted tubular housing inserted into each borehole from which a reflected drilling beam is laterally directed by an angularly adjusted reflector to form a bore passage; U.S. Pat. No. 3,871,485 to Keenan, Jr. in which a laser beam generator positioned in a wellhole is electrically connected to an inhole voltage generator actuated by drilling mud or other liquid passing through a laser beam housing connected to the drill string and a reflecting crystal for the laser beam is positioned within the laser beam housing to reflect the beam in an elliptical pattern across the formation to be penetrated; U.S. Pat. No. 4,090,572 to Welch in which a laser beam for drilling gas, oil or geothermal wells in geological formations and for "fracing" the pay zones of such wells to increase recovery is projected into a wellbore along a beam guide so as to make available laser energy adequate to melt or vaporize the formation under downhole conditions; and U.S. Pat. No. 5,107,936 to Foppe in which a gap defining the outer profile of a borehole is melted down and the drill core surrounded by this gap is extracted at intervals through the melting zone. None of these references describes ways in which the conventional drill casing liner can be eliminated.

SUMMARY OF THE INVENTION

Accordingly, it is one object of this invention to provide a method and apparatus for drilling wells which eliminates the requirement of conventional drilling operations of installing drill casing liners.

It is another object of this invention to provide a method and apparatus for drilling wells which addresses problems associated with water encountered in the formations being drilled.

These and other objects of this invention are addressed by drilling lasers which include, in addition to laser cutting drill heads, a plurality of fluid (gas and/or liquid) purging and cooling nozzles in combination with a laser suitable for melting the rock formations encountered during the drilling operation whereby the molten rock is cooled to produce an in situ borehole liner.

More particularly, the invention disclosed herein is a well drilling apparatus comprising a drill head assembly having a front section and a back section and comprising a transparent drill head enclosure. A laser energy assembly is disposed within the transparent drill head enclosure oriented to direct a laser beam ahead of the front section of the drill head assembly. Mirrors or other reflecting surfaces may be disposed within the transparent drill head enclosure to redirect the laser beam at an angle with respect to the borehole wall produced by the drilling operation. Liner means for creating an in situ well liner are disposed proximate the back section of the drill head assembly. The liner means preferably comprises a plurality of cooling fluid nozzles oriented to direct a cooling fluid outwardly from the drill head assembly. Although typically employed laser drilling of the well, the invention disclosed herein may be used in wells drilled by conventional means to address problems, such as water inflow, that may arise during or subsequent to the drilling operation.

BRIEF DESCRIPTION OF THE DRAWINGS

These and other objects and features of this invention will be better understood from the following detailed description taken in conjunction with the drawings wherein.

DETAILED DESCRIPTION OF THE PRESENTLY PREFERRED EMBODIMENTS

Figure 1:
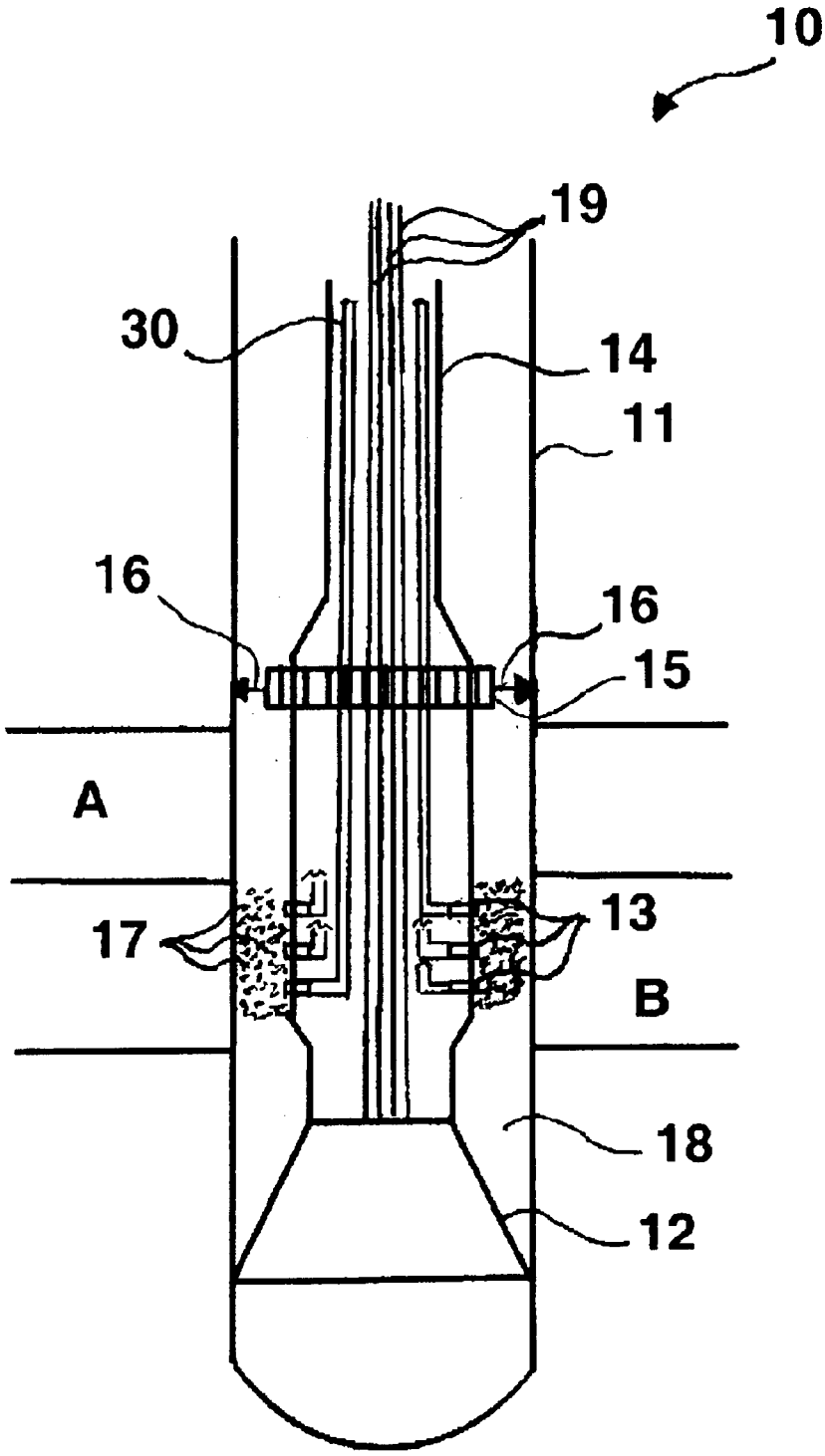
FIG. 1 is a diagram showing a laser drill head assembly in accordance with one embodiment of this invention.

As previously stated, traditional oil well drilling requires the use of a drill casing liner to prevent sand production with the oil as it is retrieved from the ground by way of the well.

In addition to the added financial burden on the drilling and production costs encountered when using these liners, there is also the added time required for installation. I have found that the use of drilling lasers in combination with fluid purging and/or cooling nozzles can accomplish the same objectives as a traditional liner, but in a much simpler and more efficient manner. Any combination of gas and/or liquid fluids that can provide control of the phases of the rock at in situ conditions may be employed for purging and/or cooling. Exemplary of such fluids are air, argon and liquid forms of gases, such as liquid nitrogen. In addition, water is kept out of the well and prevented from mixing with the oil as a result of the sealing over of the formations containing the water during the laser drilling operation, thereby eliminating the threats associated with the water.

When a laser is used to penetrate rock formations through melting of the rock material, there exists a period of time during which the rock remains in a molten form. During this period of time, the rock formation is malleable. By attaching a high pressure fluid nozzle to, or otherwise incorporating a high pressure fluid nozzle into, the laser drilling apparatus, the molten rock can be forced against the walls of the borehole. When exposure to the laser energy ceases and cooling jets are quickly applied, the molten rock reforms. The result is a layer of rock having a plurality of holes, which layer of rock functions in much the same manner as a traditional liner. This virtual liner allows fluids to flow through it, in particular oil, while simultaneously preventing mixture with sands and other particles that can interfere with the oil production process.

Due to the properties of the molten rock under the conditions in the borehole, the pressure and intensity of the fluid jets can be adjusted to enable formation of a plurality of holes in the molten rock. In addition, the direction of the fluid jets can be adjusted to optimize production. Hole sizes are controllable by suitable adjustment of the pressure, intensity and/or direction of the fluid jets, the desired size holes being selected on the basis of the desired objective, e.g. promotion of oil flow into the borehole, promotion of gas flow into the borehole and/or prevention of unconsolidated sand from flowing into the borehole.

In those cases where water is encountered in a formation, rather than using high pressure fluids, fluid jets at lower pressure are used to force the molten rock against the walls of the borehole. When the lower pressure fluid is spread over the entire rock surface, the small holes formed when using high pressure fluid streams do not form. As a result, when the rock reforms, the result is a sealed rock layer with substantially lower permeability, which prevents water from entering the borehole. Because the cooling nozzles can be employed in a gradual manner, the molten rock is able to spread more evenly against the borehole wall, providing a degree of smoothness to the sealed layer.

The critical element of the method and apparatus of this invention is the ability of the laser to convert the rock material to a molten state. Only in this state can the rock be reworked such that, upon reformation, it will act in a specific desired manner. The laser employed in the method and apparatus of this invention must be of sufficient power to melt the rock, but not so powerful as to completely vaporize the rock material. It is essential that the rock material enter a molten, workable state. The precise manner in which the laser energy is presented to the rock is not critical; any suitable means may be employed.

During the drilling operation, in addition to the vaporization of rock material, minerals within the rocks may also undergo gas dissociation, decomposition and/or dehydration. In accordance with one embodiment of this invention, an expandable sealing bellows or other suitable means are provided to ensure that any vapors resulting from the vaporization of rock or other materials, such as those produced by gas dissociation, decomposition and/or dehydration of minerals, generated during the drilling operation do not escape from the borehole. Although vaporization is not intended for most applications, it may, however, occur in some cases and, thus, must be controlled.

The nozzles used for reworking the molten rock material must be provided with sufficient power and working fluid, either from a downhole system or a system disposed on the earth's surface. The nozzles may be attached to a pressurized hose supplying fluids, typically air, from the surface, or a downhole compressor could be built into the drill head assembly. In the latter case, the compressor must be of sufficient power to provide a consistent high pressure air stream drawing from the air within the borehole. Likewise, the cooling jets could be fed cool air through hoses or tubes from the earth's surface or a downhole cooling device could be employed. The creation of molten rock will release large amounts of heat and, if the cooling jets are to use downhole air to induce a rapid phase change in the molten rock, air temperature control must also be employed.

Deployment of the expandable sealing means to prevent the escape of vapors and other materials produced during the drilling operation results in substantial pressurization of air within the borehole surrounding the drill head assembly. In accordance with one embodiment of this invention, the fluid nozzles are connected to one or more conduits having a fluid inlet in fluid communication with the borehole space surrounding the drill head assembly and a fluid outlet in fluid communication with the fluid inlet of the fluid nozzles. In this way, the high pressure air within the borehole may be employed to effect the molding and cooling of the molten rock as discussed herein above.

Figure 2:
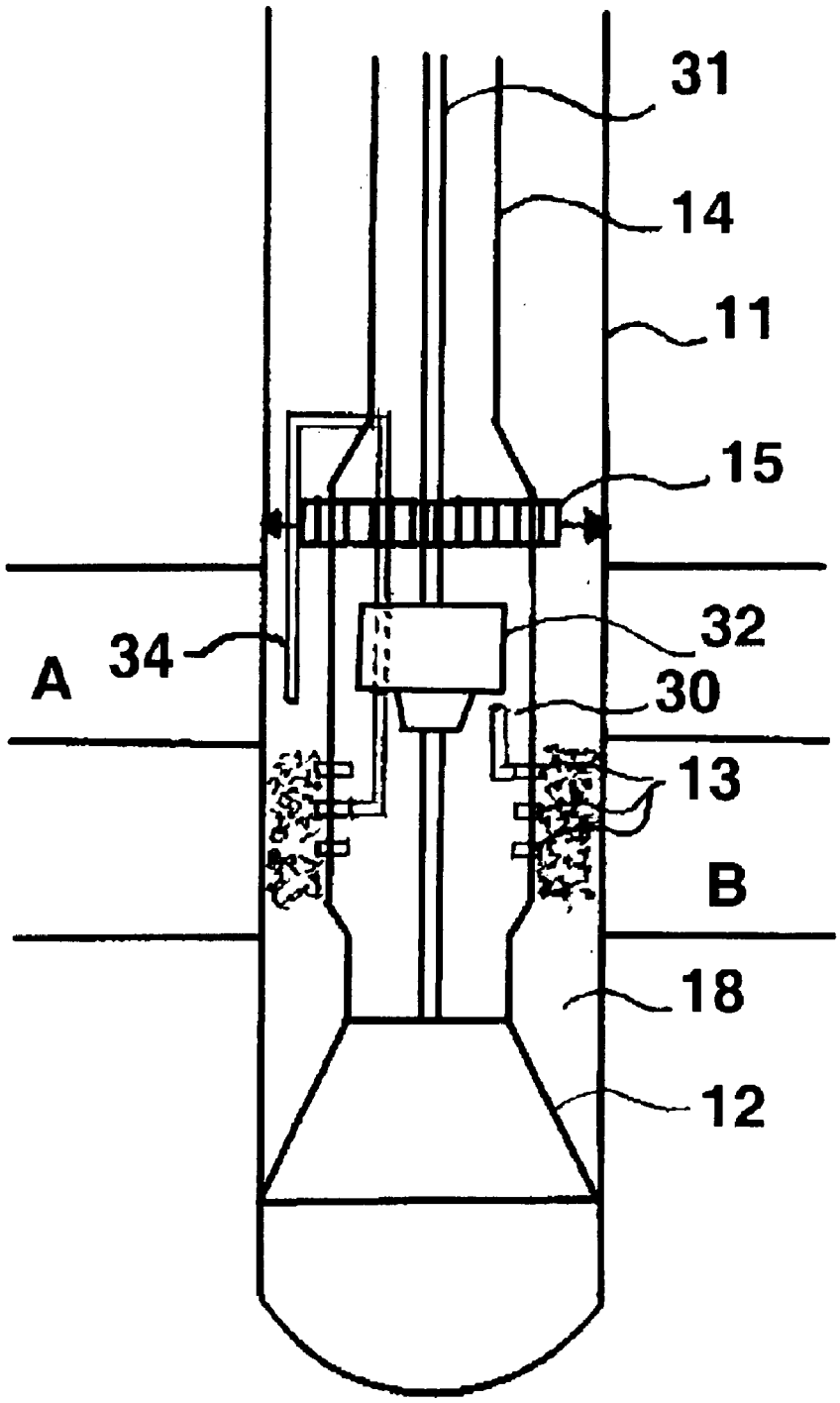
FIG. 2 is a diagram showing a laser drill head assembly in accordance with one embodiment of this invention.
Figure 3:
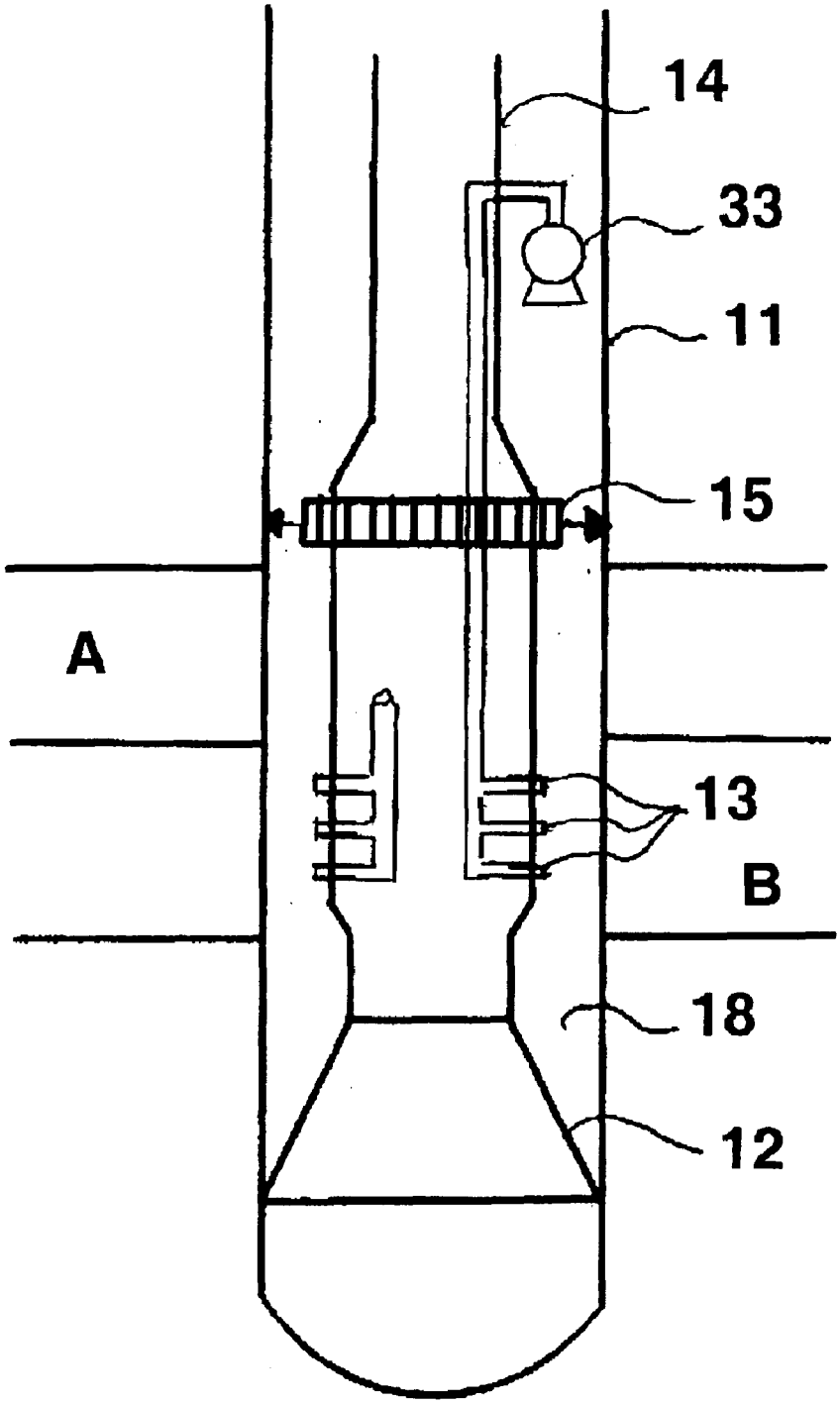
FIG. 3 is a diagram showing a laser drill head assembly in accordance with another embodiment of this invention.

A drill head assembly of a well drilling apparatus suitable for creating an in situ borehole liner and having a front section for melting of the rock formation and a back section in accordance with various embodiments of this invention is shown in FIGS. 1–3. As used herein, the term "front section" refers to that portion of the drill head assembly through which laser energy is emitted while the term "back section" refers to that portion of the drill head assembly through which control of the drill head assembly is provided, typically by operable connection of cables to control means disposed above ground. Also as used herein, the term "upstream" when used in connection with the relative disposition of elements refers to the direction opposite to the direction of drilling.

Figure 4:
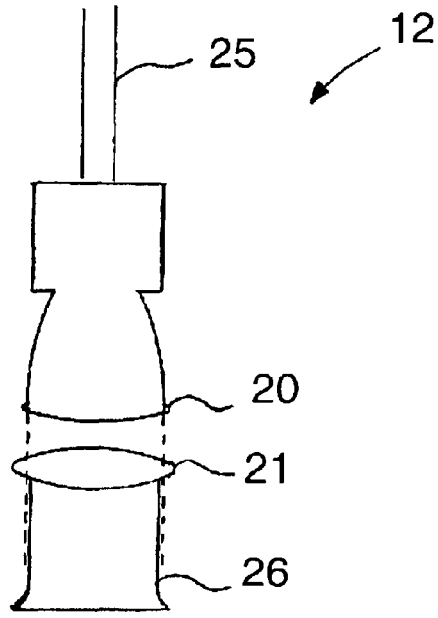
FIG. 4 is a diagram showing a portion of the laser energy assembly of the laser drill head assembly in accordance with one embodiment of this invention.
Figure 5:
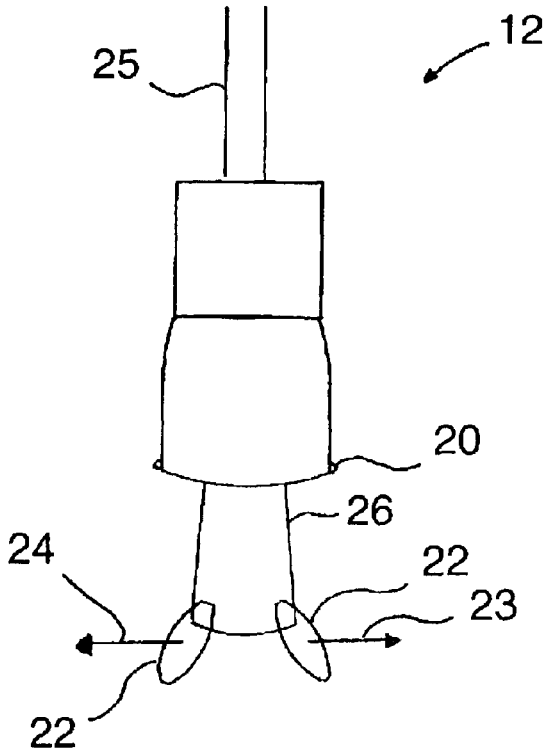
FIG. 5 is a diagram showing a portion of the laser energy assembly of the laser drill head assembly in accordance with one embodiment of this invention.

As shown in FIG. 1, drill head assembly 10 is disposed within borehole 11 and comprises a transparent drill head enclosure 18 and a laser energy assembly 12 disposed within transparent drill head enclosure 18, which is adaptable to direct a laser beam 26, as shown in FIGS. 4 and 5, either straight ahead (FIG. 4) or laterally (FIG. 5). In accordance with one embodiment of this invention, laser energy assembly 12 comprises at least one optical fiber 19 having a light energy output end disposed within said transparent drill head enclosure 18 and a light energy input end connected to a light energy source distal from the drill head assembly 10. In accordance with one embodiment of this invention, the at least one optical fiber 19 is disposed within cable 25 and connected to a light energy source disposed above ground. Alternatively, a laser energy source 32 may be disposed within the borehole, preferably within the transparent drill head enclosure 18 as shown in FIG. 2. Laser energy assembly 12 comprises at least one mirror 21 suitable for focusing the laser beam 26 ahead of the drill head assembly 10. In accordance with an alternate embodiment as shown in FIG. 5, laser energy assembly 12 comprises a plurality of mirrors 22 oriented to direct laser beam 26 laterally outward from laser energy assembly 12 as indicated by arrows 23 and 24.

Drill head assembly 10 comprises liner means for creating an in situ borehole liner, which liner means are disposed upstream of laser energy assembly 12. Said liner means comprise a plurality of nozzles 13 disposed upstream of laser energy assembly 12, at least a portion of which nozzles may be employed as high pressure fluid nozzles suitable for forming a plurality of holes 17 within the molten rock formed by laser energy assembly 12. In accordance with one embodiment of this invention, at least a portion of nozzles 13 deliver a low pressure coolant against the molten rock whereby a substantially smooth, substantially water impermeable liner is formed.

Although discussed herein in terms of air being used to mold and cool the molten rock within the borehole, it will be apparent to those skilled in the art that other fluids may also be employed and no intent to limit the scope of suitable fluids should be inferred from the descriptions of exemplary embodiments. As previously stated, nozzles 13 must be provided with sufficient power and air to function. Such power and air may be provided from within the borehole, from above ground or a combination thereof. In accordance with one embodiment of this invention, such power and air are provided by a down-hole system comprising a down-hole air compressor 33. Such a compressor must be able to provide a consistent high pressure air stream while drawing air from within the borehole. Similarly, cooling fluid may be provided by a down-hole cooling device. In accordance with an alternate embodiment, said power and air are provided from systems located on the surface of the ground surrounding the borehole. In this case, air and/or cooling fluid are provided from the surface through one or more hoses or tubes 30 connecting the nozzles 13 to the air/cooling fluid supply. In accordance with yet a further embodiment of this invention, when expandable sealing means 15 are in an expanded state, effectively sealing the region of borehole 11 downstream of expandable sealing means 15 and creating a substantial air pressure within said region, air may be provided through conduit 34 to fluid nozzles 13. In accordance with one preferred embodiment of this invention, power is provided to laser energy assembly 12 through cables 14 which extend from laser energy assembly 12 up to a power supply (not shown) disposed at the surface.

As previously indicated, a critical element of the method and apparatus of this invention is the ability of the laser to convert rock into a molten state. Only in this state can the rock be reworked such that, upon reformation, it will act in a specific desired manner. The laser must be of sufficient power to melt the rock, but not so great as to completely vaporize the rock. It is critical that the rock enter a molten, workable state. It will be apparent to those skilled in the art that the vaporization of at least some of the rock under certain circumstances may be unavoidable. To the extent that vaporization does occur, control of the vaporized rock is important. Accordingly, in accordance with one embodiment of this invention, drill head assembly 10 comprises a laterally expandable seal means proximate the back section of drill head assembly 10. In accordance with one embodiment of this invention, said expandable seal means comprises an expandable bellows 15 disposed upstream of nozzles 13, which expandable bellows are expandable in the direction indicated by arrow 16 to form a seal with the borehole wall 11, thereby ensuring that any rock that may be vaporized during the drilling operation does not escape from the hole.

Experimentation has demonstrated that lasers are capable of melting rock and increasing permeability. The high pressure nozzles 13 produce high pressure jets which can be used to manipulate the molten rock into new forms. As shown in FIG. 1, the drill head assembly 10 in accordance with one embodiment of this invention has produced a sealed zone, designated as "A", where the laser has been used to melt and smooth the rock layer. Towards the middle of FIG. 1, a target zone "B" is shown in which the liner creation device of this invention comprising the air and cooling nozzles 13 protruding from all sides is disposed. Directly below the nozzles 13 is the laser energy assembly 12, which comprises suitable configurations of mirrors, lenses and crystal reflectors.

While in the foregoing specification this invention has been described in relation to certain preferred embodiments, and many details are set forth for purpose of illustration, it will be apparent to those skilled in the art that this invention is susceptible to additional embodiments and that certain of the details described in this specification and in the claims can be varied considerably without departing from the basic principles of this invention.

I claim:

1. A well drilling apparatus comprising:

a drill head assembly having a front section and a back section, said drilling head assembly comprising a transparent drill head enclosure;

a laser energy assembly disposed within said transparent drill head enclosure oriented to direct a laser beam at least one of ahead of said front section of said drill head assembly and at an angle with respect to a forward direction of movement of said drilling apparatus; and liner means for creating an in situ borehole liner disposed proximate said back section of said drill head assembly.

2. An apparatus in accordance with claim 1, wherein said liner means comprises a plurality of fluid nozzles oriented to direct a fluid outwardly from said drill head assembly.

3. An apparatus in accordance with claim 2, wherein at least a portion of said fluid nozzles are air nozzles.

4. An apparatus in accordance with claim 3, wherein said air nozzles are high pressure air nozzles.

5. An apparatus in accordance with claim 2, wherein said fluid nozzles are operatively to a compressor disposed within a borehole proximate said drill head assembly, whereby said compressor is in fluid communication with said fluid nozzles.

6. An apparatus in accordance with claim 2, wherein said fluid nozzles are connected to conduits extending from said fluid nozzles to a fluid source disposed above ground.

7. An apparatus in accordance with claim 1 further comprising a laterally expanding seal disposed proximate said back section of said drill head assembly.

8. An apparatus in accordance with claim 7, wherein said laterally expandable seal is an expandable sealing bellows.

9. An apparatus in accordance with claim 1, wherein said laser energy assembly comprises a laser energy source disposed within said transparent drill head enclosure.

10. An apparatus in accordance with claim 1, wherein said laser energy assembly comprises at least one optical fiber having a light energy output end disposed within said transparent drill head enclosure and a light energy input end connected to a light energy source distal from said drill head assembly.

11. An apparatus in accordance with claim 10, wherein said light energy output end of said optical fiber is adjustable, whereby said laser beam may be directed at said angle with respect to a forward direction of movement of said drilling apparatus.

12. An apparatus in accordance with claim 1 further comprising at least one adjustable laser beam reflector disposed within said transparent drill head assembly suitable for redirecting said laser beam at said angle with respect to a forward direction of movement of said drilling apparatus.

13. A method for drilling a well comprising the steps of:

directing a laser beam from a laser energy assembly disposed within a transparent drill head enclosure of a drill head assembly into a ground comprising at least one rock formation to be drilled;

melting a portion of said rock formation forming molten rock;

directing said drill head assembly into said molten rock forming a borehole having a borehole wall;

directing at least one air stream from said drill head assembly into said molten rock forming said molten rock against said borehole wall; and cooling said molten rock against said borehole wall forming a borehole liner.

14. A method in accordance with claim 13, wherein said at least one air stream is at sufficient pressure and intensity to form a plurality of holes within said molten rock against said borehole wall, thereby rendering said borehole wall sufficiently porous to enable fluid flow into said borehole.

15. A method in accordance with claim 13, wherein said at least one air stream is at a sufficient pressure and intensity to preclude formation of holes within said molten rock against said borehole wall, thereby sealing said borehole against infiltration by undesired fluids.

16. A method in accordance with claim 15, wherein one of said undesired fluids is water.

17. A method in accordance with claim 13, wherein said laser beam is at sufficient power to melt said rock formation and substantially avoid vaporization of said rock formation.

18. A method in accordance with claim 13 further comprising sealing said borehole behind said drill head assembly whereby vaporized rock formed during melting of said rock formation is prevented from exiting said borehole.

* * * * *